US009929001B2

(12) United States Patent
Asano

(10) Patent No.: US 9,929,001 B2
(45) Date of Patent: Mar. 27, 2018

(54) MASS SPECTROMETER

(71) Applicant: SHIMADZU CORPORATION, Kyoto-shi, Kyoto (JP)

(72) Inventor: Natsuyo Asano, Kyoto (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 0 days.

(21) Appl. No.: 15/511,332

(22) PCT Filed: Sep. 17, 2014

(86) PCT No.: PCT/JP2014/074591
§ 371 (c)(1),
(2) Date: Mar. 15, 2017

(87) PCT Pub. No.: WO2016/042627
PCT Pub. Date: Mar. 24, 2016

(65) Prior Publication Data

US 2017/0287691 A1 Oct. 5, 2017

(51) Int. Cl.
*H01J 49/00* (2006.01)
*H01J 49/16* (2006.01)
*H01J 49/42* (2006.01)

(52) U.S. Cl.
CPC ..... *H01J 49/167* (2013.01); *H01J 49/42* (2013.01)

(58) Field of Classification Search
None
See application file for complete search history.

(56) References Cited

U.S. PATENT DOCUMENTS 7,855,355 B2 * 12/2010 Mizutani ..... H01J 49/022 250/281
9,431,226 B2 * 8/2016 Mizutani ..... H02M 3/33507

FOREIGN PATENT DOCUMENTS

JP 4687716 B2 * 5/2011 ..... H01J 49/022
WO 2007/029327 A1 3/2007
WO WO 2007029327 A1 * 3/2007 ..... H01J 49/022
WO 2014/068780 A1 5/2014
WO WO 2014068780 A1 * 5/2014 ..... H02M 3/33507

OTHER PUBLICATIONS

Written Opinion for PCT/JP2014/074591 dated Dec. 22, 2014. [PCT/ISA/237].
International Search Report for PCT/JP2014/074591 dated Dec. 22, 2014.

* cited by examiner

*Primary Examiner* — Andrew Smith
(74) *Attorney, Agent, or Firm* — Sughrue Mion, PLLC

(57) ABSTRACT

In a mass spectrometer according to the present invention, when MRM measurements for a plurality of MRM transitions need to be performed within one cycle, a measurement order rearranger determines an analysis sequence by sorting the measurement in ascending order of the absolute value of an optimum application voltage (an application voltage which gives the highest ionization efficiency) to the nozzle of the ESI probe. An analysis controller performs the analysis by controlling the high-voltage power source and other relevant units according to the determined analysis sequence. Since the voltage applied to the nozzle within one cycle has no period in which the voltage is changed in the decreasing direction with the same polarity, the cycle time becomes shorter than in a conventional device.

16 Claims, 4 Drawing Sheets

Fig. 2A

POSITIVE IONS ONLY (a1)

| ORDER | COMPOUND NAME | ION POLARITY | MRM TRANSITION | NOZZLE VOLTAGE [kV] |
|---|---|---|---|---|
| 1 | A | + | Ma1→Ma2 | +2 |
| 2 | B | + | Mb1→Mb2 | +4 |
| 3 | C | + | Mc1→Mc2 | +3 |
| 4 | D | + | Md1→Md2 | +1 |
| 5 | E | + | Me1→Me2 | +4 |

SORTED (a2)

| ORDER | COMPOUND NAME | ION POLARITY | MRM TRANSITION | NOZZLE VOLTAGE [kV] |
|---|---|---|---|---|
| 1 | D | + | Md1→Md2 | +1 |
| 2 | A | + | Ma1→Ma2 | +2 |
| 3 | C | + | Mc1→Mc2 | +3 |
| 4 | B | + | Mb1→Mb2 | +4 |
| 5 | E | + | Me1→Me2 | +4 |

Fig. 2B

NEGATIVE IONS ONLY (b1)

| ORDER | COMPOUND NAME | ION POLARITY | MRM TRANSITION | NOZZLE VOLTAGE [kV] |
|---|---|---|---|---|
| 1 | G | − | Mg1→Mg2 | -2 |
| 2 | H | − | Mh1→Mh2 | -3 |
| 3 | J | − | Mj1→Mj2 | -2.5 |
| 4 | F | − | Mf1→Mf2 | -1 |
| 5 | K | − | Mk1→Mk2 | -3 |

SORTED (b2)

| ORDER | COMPOUND NAME | ION POLARITY | MRM TRANSITION | NOZZLE VOLTAGE [kV] |
|---|---|---|---|---|
| 1 | F | − | Mf1→Mf2 | -1 |
| 2 | G | − | Mg1→Mg2 | -2 |
| 3 | J | − | Mj1→Mj2 | -2.5 |
| 4 | H | − | Mh1→Mh2 | -3 |
| 5 | K | − | Mk1→Mk2 | -3 |

Fig. 3A
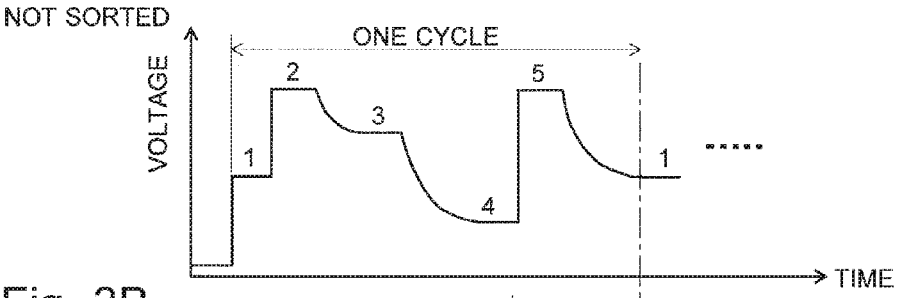
Fig. 3B
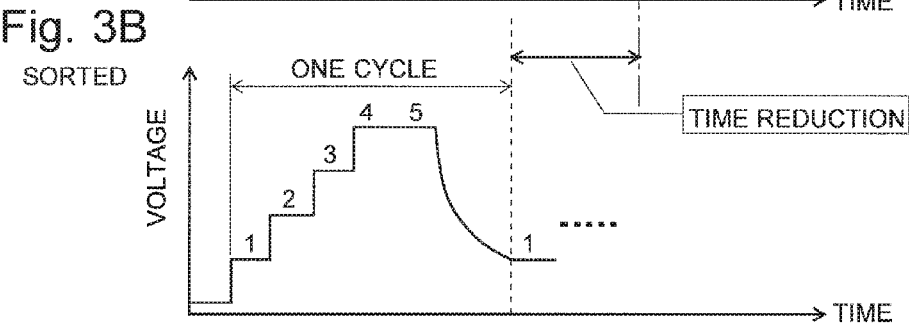
Fig. 4A
| ORDER | COMPOUND NAME | ION POLARITY | MRM TRANSITION | NOZZLE VOLTAGE [kV] |
|---|---|---|---|---|
| 1 | A | + | Ma1→Ma2 | +4 |
| 2 | B | + | Mb1→Mb2 | +3 |
| 3 | C | + | Mc1→Mc2 | +2 |
| 4 | D | − | Md1→Md2 | -3 |
| 5 | E | − | Me1→Me2 | -2 |
| 6 | F | − | Mf1→Mf2 | -1.5 |
Fig. 4B
SORTED
| ORDER | COMPOUND NAME | ION POLARITY | MRM TRANSITION | NOZZLE VOLTAGE [kV] |
|---|---|---|---|---|
| 1 | C | + | Mc1→Mc2 | +2 |
| 2 | B | + | Mb1→Mb2 | +3 |
| 3 | A | + | Ma1→Ma2 | +4 |
| 4 | F | − | Mf1→Mf2 | -1.5 |
| 5 | E | − | Me1→Me2 | -2 |
| 6 | D | − | Md1→Md2 | -3 |

MASS SPECTROMETER

CROSS REFERENCE TO RELATED APPLICATIONS

This application is a National Stage of International Application No. PCT/JP2014/074591 filed Sep. 17, 2014, the contents of all of which are incorporated herein by reference in their entirety.

TECHNICAL FIELD

The present invention relates to a mass spectrometer, and more specifically, to a mass spectrometer having a polarity-switchable high-voltage power supply device for applying, to an ion source or the like, a high voltage whose polarity depends on the polarity of an ion to be analyzed.

BACKGROUND ART

In a liquid chromatograph mass spectrometer (LC-MS) using a mass spectrometer as the detector for a liquid chromatograph (LC), an ion source which employs an atmospheric pressure ionization method, such as an electrospray ionization (ESI) or atmospheric pressure chemical ionization (APCI), is used in order to ionize a liquid sample eluted from a column of the LC while gasifying the same sample. For example, in an ESI ion source, a high voltage (e.g. ±several kV) having the same polarity as the ion to be analyzed needs to be applied to the tip of the nozzle from which the liquid sample is sprayed.

In such a mass spectrometer, when the detection of a positive ion and that of a negative ion is alternated with a short period of time, the polarity of the applied high voltage needs to be switched according to the polarity of the ion. For this operation, a high-voltage power supply device capable of switching the polarity of one system of output voltage is used. As a high-voltage power supply device of this type, a device described in Patent Literature 1 has been known. This high-voltage power supply device has a positive voltage generation circuit and negative voltage generation circuit, each of which includes a DC-DC conversion circuit using an isolation transformer, with one resistor parallel-connected to the positive output terminal of the positive voltage generation circuit and another resistor parallel-connected to the negative output terminal of the negative voltage generation circuit, and the two resistors connected to each other in series. Using one end of the series-connected resistors as the reference end, a high positive or negative voltage is extracted from the other end.

In this high-voltage power supply device, the high voltage is generated in each of the positive and negative voltage generation circuits by supplying a predetermined drive signal from a control circuit to a switching element included in each of the positive and negative voltage generation circuits. When the high voltage output is switched between the positive and negative polarities, the positive and negative voltage generation circuits are controlled so that the output voltage of one circuit changes from a positive high voltage +HV to zero while that of the other circuit simultaneously begins to change from zero to eventually converge to a negative high voltage −HV after overshooting this level. This intentional overshooting of the voltage which is being raised from zero is aimed at reducing the amount of time required for the positive/negative switching of the polarity.

As a high-voltage power supply device capable of an even quicker positive/negative switching of the polarity, a device disclosed in Patent Literature 2 has been known. In this high-voltage power supply device, the resistors respectively connected in parallel to the positive output terminal of the positive voltage generation circuit and the negative output terminal of the negative voltage generation circuit in the device described in Patent Literature 1 are replaced by switch circuits consisting of FET or similar devices. A circuit consisting of two resistors connected in series is connected in parallel to each of the switch circuits. A signal extracted from the connection point of these two resistors on the positive side is sent as the on/off drive control signal to the negative-side switch circuit, while a signal extracted from the connection point of the two resistors on the negative side is conversely sent as the on/off drive control signal to the positive-side switch circuit.

In high-voltage power supply device, for example, consider the situation where the positive voltage generation circuit is operated to make the high positive voltage +HV appear at its output terminal, while the negative voltage generation circuit is in effect inactive, with the voltage at its output terminal at approximately zero volts. In this situation, a voltage which equals the high voltage +HV divided by the ratio between the resistance values of the two resistors at the positive output terminal is generated at the connection point of these two resistors and given to the switch circuit on the negative side. Consequently, this switch circuit turns on, and the conduction state is established between the output terminals of the negative voltage generation circuit. From this state, when the polarity of the voltage is switched from positive to negative, the positive voltage generation circuit is deactivated, while the negative voltage generation circuit is activated. When the voltage at the output terminal of the positive voltage generation circuit decreases to a predetermined level, the switch circuit on the negative side turns off. Meanwhile, the voltage at the output terminal of the negative voltage generation circuit increases, and this time, the switch circuit on the positive side turns on. Consequently, the electric charges remaining at the output terminal of the positive voltage generation circuit are rapidly discharged through the switch circuit, so that the output voltage of the positive voltage generation circuit rapidly decreases to zero.

In this manner, when the positive/negative switching of the polarity is performed, the two switch circuits respectively provided at the positive and negative output terminals function so as to induce the forced discharge of the electric charges remaining at the output terminal on the side corresponding to the polarity which is about to change to zero. This leads to a quick decrease in the voltage which is about to change to zero, so that the positive/negative switching of the polarity is more quickly achieved.

Using such a high-voltage power supply device as the voltage supply source for a nozzle of an ESI ion source makes it possible to perform an LC/MS analysis while alternately switching a positive ion measurement mode and negative ion measurement mode with a short period of time. This is extremely useful, in particular, for a simultaneous multi-component analysis or similar analyses since both the compounds which easily turn into positive ions and the compounds which easily turn into negative ions can be exhaustively detected.

In recent years, an even greater improvement in the sensitivity of mass spectrometers has been demanded, in particular, for such purposes as the quantitative determination of trace amounts of components. Conventionally, it has not been a common practice to finely control the value itself of the voltage applied to the nozzle in an ESI ion source. However, it is commonly known that appropriately adjusting the voltage applied to the nozzle according to such factors as the properties of the target compound improves the ionization efficiency and provides a higher level of ion detection sensitivity than applying a fixed level of voltage. The optimum voltage to be applied to the nozzle depends not only on the kind of compound but also the kind of dilution solvent in the sample, the kind of mobile phase, supply conditions of the mobile phase and other factors. Accordingly, in recent years, attempts have been made to improve the detection sensitivity for each compound in a SIM (selected ion monitoring) or MRM (multiple reaction monitoring) measurement by adjusting the voltage applied to the ESI ion source for each target ion in the SIM measurement or each target MRM transition (which is a combination of the precursor ion and the product ion).

In an MRM measurement performed in a simultaneous multi-component analysis, it is normally necessary to change the MRM transition within a short period of time of a few msec to several tens of msec. However, attempting to change the value of the voltage applied to the nozzle for such a change of the MRM transition causes the following problem:

Not only the aforementioned high-voltage power supply device but also any high-voltage power supply device of the same type normally has a capacitor connected to its output terminal to smooth the output voltage. In the phase of increasing the voltage value (absolute value of the voltage), the voltage rises at high rates since the capacitor can be quickly charged by increasing the output current. By comparison, in the phase of decreasing the voltage value (absolute value of the voltage), the electric charges accumulated in the capacitor need to be discharged through a channel including output resistors and other elements. Since the discharge rate depends on the time constant, the rate of decrease in the voltage is considerably lower than that of the increase in the voltage. In the high-voltage power supply device described in Patent Literature 2, when the polarity of the output voltage is changed, the switch circuit provided at the output terminal effectively works to discharge the accumulated electric charges. However, when the output voltage is decreased without changing its polarity, the switch circuit does not work, so that the voltage requires time to change. For example, in one example of the high-voltage power supply device described in Patent Literature 2, a voltage-changing process for increasing the voltage from +2 kV to +5 kV requires 1 to 5 msec, while a voltage-changing process for decreasing the voltage from +5 kV to +2 kV requires 10 to 50 msec, which is approximately ten times slower than in the voltage-increasing process.

For example, in such applications as a simultaneous multi-component analysis of agricultural chemicals residues, the cycle of sequentially performing MRM measurements for the ions originating from a plurality of target compounds is repeated. If a considerable amount of time is required for the changing of the applied voltage as in the previously described case, it will be necessary to shorten the data acquisition time (or so-called "dwell time") or limit the number of MRM transitions to be concurrently subjected to the measurement. In the former case, the detection sensitivity will be sacrificed. In the latter case, fewer compounds can be simultaneously subjected to the measurement, and in some cases it may be necessary to perform the measurement multiple times for the same sample.

CITATION LIST

Patent Literature

Patent Literature 1: JP 4687716 B
Patent Literature 2: WO 2014/068780 A

SUMMARY OF INVENTION

Technical Problem

The present invention has been developed to solve the previously described problem. Its objective is to provide a mass spectrometer in which such unnecessary periods of time as the settling time for stabilizing the voltage are maximally reduced so that an efficient analysis can be performed by shortening the period of time required for each cycle or elongating the dwell time for each MRM transition when, for example, MRM measurements for a plurality of MRM transitions are repeatedly performed.

Solution to Problem

The present invention developed for solving the previously described problem is a mass spectrometer including: an ion source for ionizing a compound in a sample; a mass separation unit for separating ions originating from a compound according to their mass-to-charge ratios; and a detection unit for detecting ions separated according to their mass-to-charge ratios, the mass spectrometer capable of repeatedly performing the cycle of performing a plurality of selected ion monitoring (SIM) measurements with different target ions or a plurality of multiple reaction monitoring (MRM) measurements with different MRM transitions which are combinations of a precursor ion and a product ion to be subjected to a measurement, and the mass spectrometer further including:

a) an information collector for collecting information concerning the target ions of the plurality of SIM measurements or the target MRM transitions of the plurality of MRM measurements performed in one cycle within an arbitrary measurement time range; and b) a measurement order determiner for determining the order in which the SIM measurements for the different ions or the MRM measurements for the different MRM transitions are performed within one cycle, the measurement order determiner configured to organize the measurements for the SIM measurement target ions or MRM transitions within one cycle collected by the information collector, into groups with respect to each suitable polarity of an application voltage to the ion source for each of the SIM measurement target ions or MRM transitions, and to determine the order of the measurements within one cycle by sorting the measurements by the absolute value of the application voltage within each group of the same polarity.

The mass spectrometer according to the present invention may further include a control unit for controlling each relevant unit so as to perform the SIM or MRM measurements according to the order of the measurements determined by the measurement order determiner.

A typical form of the mass spectrometer according to the present invention is a quadrupole mass spectrometer including one quadrupole mass filter as the mass separation unit, or a tandem quadrupole mass spectrometer which includes, as the mass separation unit, two quadrupole mass filters respectively placed on the front and rear sides of a collision cell.

In the mass spectrometer according to the present invention, the ion source is typically an ion source which employs an electrospray ionization (ESI) method and includes a nozzle for spraying a sample solution while electrically charging this solution. In this case, the aforementioned application voltage is the voltage applied to the nozzle of the ESI ion source.

As one example, consider the case where the mass spectrometer according to the present invention is a tandem quadrupole mass spectrometer, and a sample which has passed through a liquid chromatograph is introduced into this tandem quadrupole mass spectrometer in order to perform a quantitative analysis on one or more known kinds of target compounds contained in the sample.

In this case, the MRM transitions corresponding to the target compounds, i.e. the combinations of the mass-to-charge ratio of the precursor ion and that of the product ion are previously known. Accordingly, an analysis operator specifies a measurement time range corresponding to the timing of the elution (i.e. the retention time) of each target compound from the exit port of the column as well as the MRM transition corresponding to the same compound. It is often the case that a plurality of MRM transitions are specified for one compound. In the case of a simultaneous multi-component analysis, the measurement time ranges for a plurality of compounds overlap each other. Therefore, even when each compound has only one MRM transition specified for it, there may be a cycle within which MRM measurements for a plurality of MRM transitions need to be performed. Accordingly, the information collector collects information concerning the MRM transitions specified as the target of the plurality of MRM measurements performed in one cycle within an arbitrary measurement time range. The plurality of MRM transitions performed within one cycle may be MRM transitions originating from the same compound or those originating from different compounds.

The information collector may include an information specifier for allowing an analysis operator to specify ions as the target of the plurality of SIM measurements to be performed within one cycle or MRM transitions as the target of the plurality of MRM measurements. In this configuration, the plurality of MRM transitions specified by the analysis operator via the information specifier are directly designated as the MRM transitions to be performed within one cycle.

When there are different MRM transitions as in the previously described case, the voltage applied to the ion source may have different optimum values. Accordingly, the measurement order determiner determines an optimum value of the application voltage for each of the plurality of MRM transitions to be performed within one cycle. After organizing the MRM transitions into groups with respect to the polarity of the application voltage, the measurement order determiner sorts the measurements by the absolute value of the application voltage within each group of the same polarity. In other words, after the MRM transitions are divided into a group requiring positive application voltages and a group requiring negative application voltages, the plurality of MRM transitions with positive application voltages are sorted by the absolute value of the application voltage, and the plurality of MRM transitions with negative application voltages are also sorted by the absolute value of the application voltage.

The information concerning the suitable application voltage for each MRM transition can be entered by the analysis operator along with the corresponding MRM transition when the MRM transitions are specified by the information specifier or other methods. It is also possible to automatically derive the suitable application voltages for the specified MRM transitions using a set of previously given information, such as a table in which the correspondence relationship between the MRM transitions and the suitable application voltages for various compounds has been respectively stored.

As noted earlier, the optimum application voltage to the ESI ion source or other devices depends not only on the kind of compound but also other conditions, such as the kind of mobile phase in the LC or kind of sample solvent. It is preferable to consider those conditions as much as possible in determining the suitable application voltage. For example, even when the same MRM transition in the same compound is specified, if a different kind of mobile phase is used in the LC, it is preferable to obtain a more suitable application voltage which corresponds to the kind of mobile phase.

As noted earlier, high-voltage power supply devices commonly used in mass spectrometers require a longer period of time in the voltage-decreasing phase than in the voltage-increasing phase. Accordingly, in order to maximally reduce the amount of decrease in the voltage, the measurement order determiner should preferably sort the measurements in ascending order of the absolute value of the application voltage within the group of the same polarity.

In particular, in the case of the high-voltage power supply device disclosed in Patent Literature 2, since the positive/negative switching of the polarity is quickly performed, the switching of the polarity occurs quickly even when a positive application voltage is switched to the negative polarity after the voltage has reached the largest positive value among the voltage values arranged in ascending order of their absolute values. Similarly, the switching of the polarity occurs quickly when a negative application voltage is switched to the positive polarity after the voltage has reached the largest negative value among the voltage values arranged in ascending order of their absolute values. Therefore, the order of the measurements determined by the measurement order determiner is in effect free from the voltage-changing operation in the voltage-decreasing direction in which a considerable period of time is required for the voltage to change. Consequently, the settling time for changing the voltage is shortened.

Advantageous Effects of the Invention

With the mass spectrometer according to the present invention, when a measurement is performed while the voltage applied to the ion source or other devices is changed in a stepwise manner within a predetermined measurement time range, the voltage which has been changed quickly stabilizes at the next level, so that the settling time in which the voltage is unstable is shortened. Therefore, as compared to the conventional device, when the cycle time which is the period of one cycle is the same, the effective data acquisition time, i.e. the dwell time, in the SIM or MRM measurement becomes longer, so that the ion detection sensitivity will be improved. If the dwell time has the same length as in the conventional device, the cycle time can be shortened by the amount corresponding to the decrease in the settling time, so that the sampling period can be shortened so as to increase the number of data points obtained within the period of time over which one compound is eluted from the LC in the previous stage. Therefore, the peak top can be assuredly located, and the shape of the skirt portion of the peak can be more exactly reproduced. Consequently, the peak area can be more accurately determined, so that the accuracy of the quantitative determination based on the peak area will be improved.

BRIEF DESCRIPTION OF DRAWINGS

FIGS. 2A and 2B show one example of the analysis sequence before and after the measurement order rearrangement process in the case of performing a plurality of MRM measurements for only positive or negative ions within one cycle in the tandem quadrupole mass spectrometer of the present embodiment.

FIGS. 3A and 3B are diagrams showing a temporal change in the application voltage corresponding to the analysis sequence shown in FIG. 2A.

FIGS. 4A and 4B show one example of the analysis sequence before and after the measurement order rearrangement process in the case of performing a plurality of MRM measurements for both positive and negative ions within one cycle in the tandem quadrupole mass spectrometer of the present embodiment.

DESCRIPTION OF EMBODIMENTS

A tandem quadrupole mass spectrometer as one embodiment of the present invention is hereinafter described with reference to the attached drawings.

Figure 1:
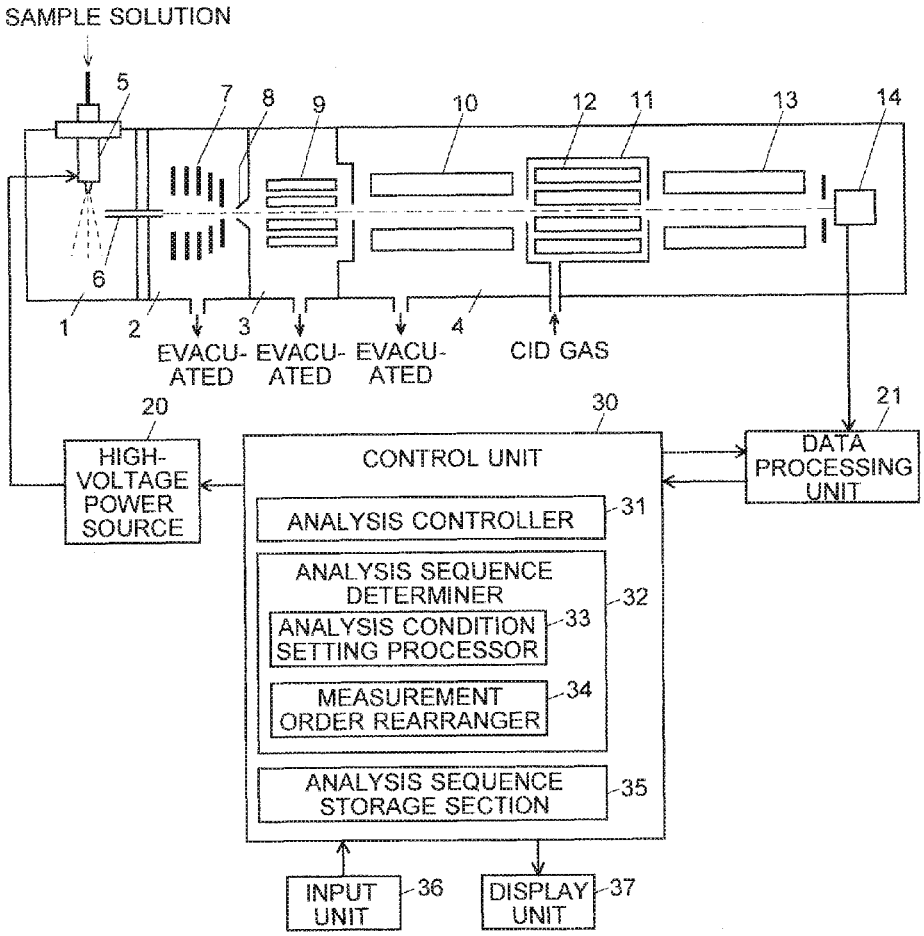
FIG. 1 is a configuration diagram of the main components of a tandem quadrupole mass spectrometer as one embodiment of the present invention.

FIG. 1 is a configuration diagram showing the main components of the tandem quadrupole mass spectrometer of the present embodiment.

The tandem quadrupole mass spectrometer of the present embodiment has the configuration of a multi-stage differential pumping system including an ionization chamber 1 maintained at approximately atmospheric pressure and an analysis chamber 4 evacuated to a high degree of vacuum by a high-performance vacuum pump (not shown), between which first and second intermediate vacuum chambers 2 and 3 are provided having their degrees of vacuum increased in a stepwise manner. The ionization chamber 1 contains an ESI probe 5 constituting an ESI ion source which is continuously supplied with a sample solution eluted from the exit port of the column of an LC (not shown). A high voltage is applied from a high-voltage power source 20 to the nozzle at the tip of the probe 5. The sample solution which has reached this nozzle is sprayed into the ionization chamber 1 while receiving an imbalanced polarity of electric charges. The droplets of the sprayed sample solution are gradually divided into smaller sizes due to the electrostatic force and other kinds of forces. During this process, ions which originate from the compounds in the sample are produced.

The ionization chamber 1 communicates with the first intermediate vacuum chamber 2 in the next stage through a thin heated capillary 6. The various ions produced within the ionization chamber 1 are drawn into the heated capillary 6 due mainly to the pressure difference between the two ends of the heated capillary 6, to be sent into the first intermediate vacuum chamber 2. The ions are converged by an ion guide 7 placed in the first intermediate vacuum chamber 2 and sent into the second intermediate vacuum chamber 3 through the small hole formed at the apex of a skimmer 8. The ions are further converged by an ion guide 9 placed in the second intermediate vacuum chamber 3, to be sent into the analysis chamber 4. The analysis chamber 4 contains a front quadrupole mass filter 10, a collision cell 11 with a multi-pole ion guide 12 placed inside, as well as a rear quadrupole mass filter 13 and an ion detector 14.

Inside the analysis chamber 4, the ions are initially introduced into the front quadrupole mass filter 10, where only an ion having a specific mass-to-charge ratio is selectively allowed to pass through the front quadrupole mass filter 10 as the precursor ion. This precursor ion is introduced into the collision cell 11 and comes in contact with a collision induced dissociation (CID) gas supplied into the collision cell 11 from a gas supply source (not shown), whereby the ion is dissociated into various product ions. The generated product ions are introduced into the rear quadrupole mass filter 13, where only ion having a specific mass-to-charge ratio is selectively allowed to pass through the rear quadrupole mass filter 13 and reach the ion detector 14. The ion detector 14 sends an ion intensity signal corresponding to the number of incident ions to a data processing unit 21 as the detection signal. The mass-to-charge ratios of the ions which are allowed to pass through the front quadrupole mass filter 10 and the rear quadrupole mass filter 13 depend on the voltage applied to the rod electrodes constituting each mass filter 10 or 13. Accordingly, by appropriately setting the voltage applied to the rod electrodes, it is possible to obtain, at a certain point in time, the ion intensity signal of a product ion having a specific mass-to-charge ratio produced from a precursor ion having a specific mass-to-charge ratio originating from a predetermined kind of compound.

A control unit 30 includes, as its functional blocks, an analysis controller 31, an analysis sequence determiner 32 for determining the analysis sequence, and an analysis sequence storage section 35 for storing the determined analysis sequence. The analysis controller 31 performs an analysis in the previously described manner by individually controlling the high-voltage power source 20 which applies a voltage to the nozzle of the ESI probe 5 with the passage of time as well as other power sources (not shown) according to the analysis sequence stored in the storage section 35. The analysis sequence determiner 32 includes an analysis condition setting processor 33 and measurement order rearranger 34 as its characteristic functional blocks. Additionally, an input unit 36 which is a keyboard and pointing device (e.g. mouse) to be operated by an analysis operator, and a display unit 37 which shows the information entered and set by the analysis operator as well as an analysis result, are connected to the control unit 30.

At least some of the functions of the control unit 30, data processing unit 21 and other units can be realized using a generally used personal computer as a hardware resource by executing, on this computer, a dedicated controlling and processing software program previously installed on the same computer.

The high-voltage power source 20 is a high-voltage power supply device capable of a quick positive/negative switching of the polarity of its output voltage, as disclosed in Patent Literature 2, in this high-voltage power source 20, when the polarity of the output voltage is switched from positive to negative, the electric charges remaining at the positive output terminal are forced to be discharged. Conversely, when the polarity of the output voltage is switched from negative to positive, the electric charges remaining at the negative output terminal are forced to be discharged. This is advantageous in that the positive/negative switching of the polarity can be more quickly performed than in the conventional case. On the other hand, when the voltage is changed in the direction in which the absolute value of the output voltage decreases without changing its polarity, the electric charges remaining at the output terminal are not forced to be discharged, so that a considerable amount of time is required for the voltage to stabilize after the switching. Accordingly, when it is necessary to quickly change the voltage applied to the nozzle of the ESI probe 5, the tandem quadrupole mass spectrometer of the present embodiment performs a characteristic control operation which will be hereinafter described.

Consider the case of a quantitative determination of known kinds of target compounds which are contained (or may possibly be contained) in a sample solution eluted from the exit port of the column of an LC (not shown). In this case, for each target compound, an MRM measurement for an MRM transition corresponding to the target compound is performed within a measurement time range in which the target compound is eluted, i.e. within a measurement time range having a predetermined time width around the retention time of the target compound. For each MRM transition, a mass chromatogram (extracted ion chromatogram) is created from the ion intensity signal obtained in the MRM measurement. On this mass spectrum, a peak which corresponds to the target compound is detected, the area of this peak is calculated, and the quantitative value is determined from the peak area value.

In a simultaneous multi-component analysis, there are a considerable number of target compounds in the first place, and furthermore, many of those compounds often have close retention times. As a result, the measurement time ranges corresponding to a plurality of target compounds overlap each other. Within such overlapping time ranges, it is necessary to sequentially perform MRM measurements for the MRM transitions corresponding to the plurality of target compounds. By repeating the cycle in which one MRM measurement is performed for each of those target compounds, the data for creating mass chromatograms of the plurality of target compounds are concurrently determined.

To perform the previously described analysis, the analysis operator specifies the measurement time range defined around the retention time of each target compound as well as one or more MRM transitions to be subjected to the measurement within that measurement time range.

Specifically, when the analysis operator performs a predetermined operation using the input unit 36, the analysis condition setting processor 33 displays, on the display unit 37, an input window prompting the entry of the measurement time range, name of the compound to be subjected to the measurement within that measurement time range, MRM transition (m/z value of the precursor ion and that of the product ion) corresponding to that compound, polarity of those ions, and other pieces of relevant information. On this input window, the analysis operator using the operation unit 36 enters the predetermined items of information. The entered information is received by the analysis condition setting processor 33. One compound does not always have only one corresponding MRM transition but actually may have two or more.

If there is a compound having a plurality of corresponding MRM transitions, it is necessary to perform MRM measurements for different MRM transitions in a time-dividing manner within the measurement time range for that compound. This also applies in the case where there is a time range in which a plurality of compounds have their measurement time ranges at least partially overlapping each other. In the measurement cycle performed within such a time range, a plurality of MRM measurements need to be performed, and the order of those measurements must be determined beforehand. Accordingly, in the following manner, the measurement order rearranger 34 determines the order of the MRM measurements to be performed within one cycle.

As one example, consider the case where MRM measurements for MRM transitions which respectively originate from five compounds as shown in FIG. 2A have been set in one cycle. For example, the shown order of the measurements is an order previously set by the analysis operator. As noted earlier, the voltage to be applied to the nozzle for obtaining the highest possible level of ionization efficiency in the ESI ion source varies depending on the kind of compound, or even for the same compound, depending on the MRM transition. Accordingly, the measurement order rearranger 34 collects information concerning the optimum nozzle voltage for the set compounds and MRM transitions. As noted earlier, the analysis operator may be allowed to additionally enter this nozzle voltage in the process of specifying the MRM transitions for the target compounds. However, it is actually cumbersome for analysis operators to enter every single value of the voltage. Accordingly, the relationship between many compounds or MRM transitions and optimum nozzle voltages may preferably be prepared beforehand and stored in an appropriate form, such as a table, so that this table (or other forms of information) can be referenced to read the optimum nozzle voltage corresponding to the target compound or MRM transition specified by the analysis operator.

In the example of table (a1) in FIG. 2A, the optimum nozzle voltages for the MRM transitions corresponding to five compounds A, B, C, D and E are +2, +4, +3, +1 and +4 kV, respectively.

In the conventional device, which does not rearrange the order of the measurements, the analysis sequence is determined so that the MRM measurements are performed in the order as shown in table (a1) in FIG. 2A. According to the analysis sequence determined in this manner, the analysis controller 31 controls relevant units to perform the analysis. In this analysis, the voltage applied from the high-voltage power source 20 to the nozzle of the ESI probe 5 within one cycle changes as shown in FIG. 3A. As already noted, a long settling time is required when the voltage is changed in the direction in which the voltage decreases without changing its polarity. For example, after the MRM measurement for the MRM transition originating from compound B is completed, a considerable amount of time is required before the MRM measurement for the MRM transition originating from compound C is initiated. Therefore, the percentage of the period of time in which the data can be effectively collected within the cycle time is not very high.

By comparison, in the tandem quadrupole mass spectrometer of the present embodiment, the measurement order rearranger 34 groups the target ions of the MRM measurements to be performed within one cycle by their polarity, and subsequently rearranges the order of the measurements (i.e. sorts the measurements) so that the absolute value of the application voltage sequentially increases from the smallest value. In the example of FIG. 2A, all ions are positive, which means that the ions having the same polarity have already been grouped. Accordingly, the remaining task is to sort the measurements in ascending order of the absolute value of the application voltage. Consequently, as shown in table (a2) in FIG. 2A, the measurements are rearranged so that the nozzle voltage sequentially changes as follows: +1, 2, 3 and +4 kV. With the measurements sorted in this manner, the analysis sequence is determined and stored in the analysis sequence storage section 35.

In the example of FIG. 2A, all MRM measurement target ions are positive ions. By comparison, FIG. 2B shows an example in which all MRM measurement target ions are negative ions. Sorting the measurements in this example in ascending order of the absolute value of the application voltage results in the measurements rearranged so that the nozzle voltage sequentially changes as follows: −1, −2, −2.5 and 3 kV.

After the analysis sequence has been determined, the analysis controller 31 performs the analysis, controlling the relevant units according to the analysis sequence stored in the analysis sequence storage section 35. Within one cycle corresponding to the example shown in table (a2) in FIG. 2A, the voltage applied from the high-voltage power source 20 to the nozzle of the ESI probe 5 changes as shown in FIG. 3B. In this case, a long settling time appears within the period from the completion of one cycle to the beginning of the next cycle, since this is the period where the voltage decreases without changing its polarity. However, the settling time within any other period is extremely short since these are the periods where the voltage increases. Therefore, the cycle time is shorter than in the case of the conventional device shown in FIG. 3A. A shorter cycle time provides a greater number of data points per unit time and thereby makes it possible to more exactly track the temporal change in the ion intensity signal, which improves the accuracy of the area of the peak corresponding to the target compound on the mass chromatogram. Therefore, the accuracy of the quantitative determination based on the peak area is also improved.

Figure 5A:
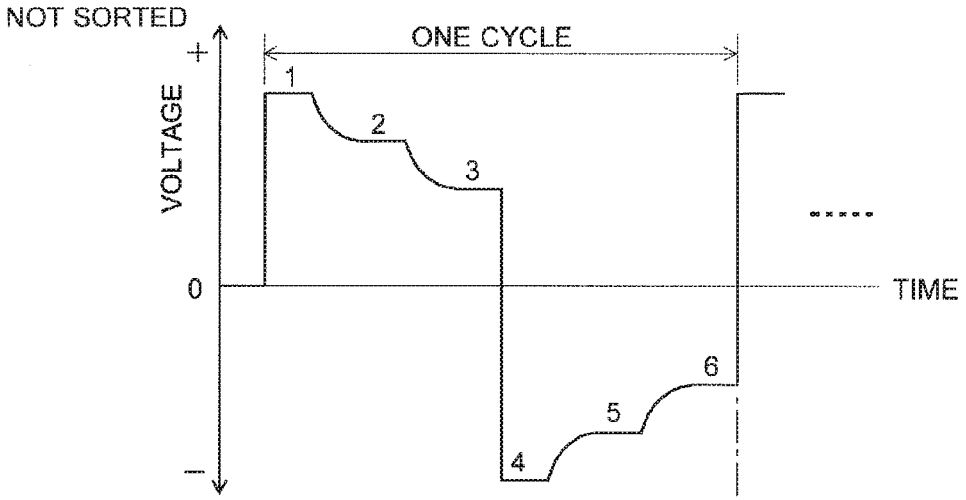
FIGS. 5A and 5B are diagrams showing a temporal change in the application voltage corresponding to the analysis sequence shown in FIGS. 4A and 4B.
Figure 5B:
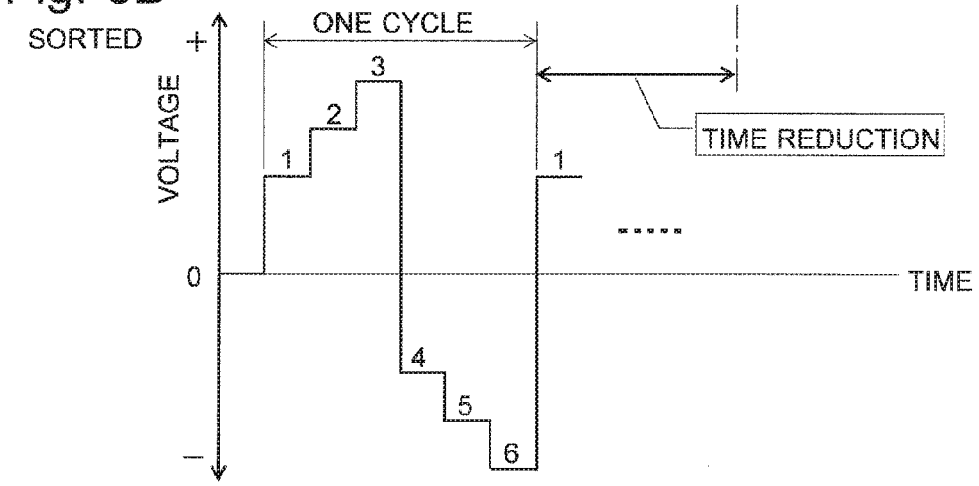

The example of FIGS. 2A through 3B is the case where the target ions of the MRM measurements performed within one cycle have the same polarity. FIGS. 4A through 5B show an example in which positive and negative ions are mixed together as the target ions of the MRM measurements performed within one cycle. In this case, the sorting of the measurements in ascending order of the absolute value of the application voltage is performed in each of the positive and negative ion groups. Consequently, as shown in FIG. 4B, the sorting for the positive group is performed so that the nozzle voltage sequentially changes from +2 through +3 to +4 kV, while the sorting for the negative group is performed so that the nozzle voltage sequentially changes from −1.5 through −2 to −3 kV. When the positive/negative polarity of the output voltage of the high-voltage power source 20 is switched, the switching operation is quickly performed. Therefore, as shown in FIG. 5B, the settling time barely occurs within one cycle, and the cycle time is considerably reduced.

As described to this point, in the tandem quadrupole mass spectrometer of the present embodiment, unnecessary settling times are reduced by sorting a plurality of concurrently performed MRM measurements by the value of the voltages applied to the ESI ion source. Therefore, it is possible to shorten the cycle time so as to increase the number of data points, or to elongate the dwell time instead of shortening the cycle time so as to improve the detection sensitivity of the ions.

Although the previous embodiment is an example of the present invention applied in a tandem quadrupole mass spectrometer, it is evident that the present invention can also be applied in a single type quadrupole mass spectrometer. In the case of a single type quadrupole mass spectrometer, the previously described sorting of the measurements can be performed when a plurality of SIM measurements are performed within one cycle.

The present invention can also be applied not only in a mass spectrometer with an ESI ion source but also in a mass spectrometer with an ion source employing a different ionization method which requires a high voltage having a polarity depending on the polarity of the ion to be applied in the ionization process, such as the DESI or PESI method.

The previous embodiment is a mere example of the present invention, and any change, modification, addition or the like appropriately made within the spirit of the present invention will naturally fall within the scope of claims of this application.

REFERENCE SIGNS LIST

1 . . . Ionization Chamber
2 . . . First Intermediate Vacuum Chamber
3 . . . Second Intermediate Vacuum Chamber
4 . . . Analysis Chamber
5 . . . ESI Probe
6 . . . Heated Capillary
8 . . . Skimmer
7, 9 . . . Ion Guide
10 . . . Front Quadrupole Mass Filter
11 . . . Collision Cell
12 . . . Multipole Ion Guide
13 . . . Rear Quadrupole Mass Filter
14 . . . Ion Detector
20 . . . High-Voltage Power Source
21 . . . Data Processing Unit
30 . . . Control Unit
31 . . . Analysis Controller
32 . . . Analysis Sequence Determiner
33 . . . Analysis Condition Setting Processor
34 . . . Measurement Order Rearranger
35 . . . Analysis Sequence Storage Section
36 . . . Input Unit
37 . . . Display Unit

The invention claimed is:

1. A mass spectrometer including: an ion source for ionizing a compound in a sample; a mass separation unit for separating ions originating from a compound according to their mass-to-charge ratios; and a detection unit for detecting ions separated according to their mass-to-charge ratios, the mass spectrometer capable of repeatedly performing a cycle of performing a plurality of selected ion monitoring (SIM) measurements with different target ions or a plurality of multiple reaction monitoring (MRM) measurements with different MRM transitions which are combinations of a precursor ion and a product ion to be subjected to a measurement, and the mass spectrometer further comprising:

a) an information collector for collecting information concerning the target ions of the plurality of SIM measurements or the target MRM transitions of the plurality of MRM measurements performed in one cycle within an arbitrary measurement time range; and b) a measurement order determiner for determining an order in which the SIM measurements for the different ions or the MRM measurements for the different MRM transitions are performed within one cycle, the measurement order determiner configured to organize the measurements for the target ions of the plurality of SIM measurements or the target MRM transitions of the plurality of MRM measurements within one cycle collected by the information collector, into groups with respect to each suitable polarity of an application voltage to the ion source for each of the ions or MRM transitions, and to determine the order of the measurements within one cycle by sorting the measurements by an absolute value of the application voltage within each group of the same polarity.

2. The mass spectrometer according to claim 1, wherein the measurement order determiner sorts the measurements in ascending order of the absolute value of the application voltage within the group of the same polarity.

3. The mass spectrometer according to claim 1, further comprising a control unit for controlling each relevant unit so as to perform the SIM or MRM measurements according to the order of the measurements determined by the measurement order determiner.

4. The mass spectrometer according to claim 1, wherein the information collector further comprises an information specifier for allowing an analysis operator to specify a plurality of SIM measurement target ions or a plurality of MRM transitions to be performed within one cycle.

5. The mass spectrometer according to claim 1, wherein the ion source is an ion source which employs an electrospray ionization (ESI) method and includes a nozzle for spraying a sample solution while electrically charging this solution, and the application voltage is a voltage applied to the nozzle.

6. The mass spectrometer according to claim 2, further comprising a control unit for controlling each relevant unit so as to perform the SIM or MRM measurements according to the order of the measurements determined by the measurement order determiner.

7. The mass spectrometer according to claim 2, wherein the information collector further comprises an information specifier for allowing an analysis operator to specify a plurality of SIM measurement target ions or a plurality of MRM transitions to be performed within one cycle.

8. The mass spectrometer according to claim 3, wherein the information collector further comprises an information specifier for allowing an analysis operator to specify a plurality of SIM measurement target ions or a plurality of MRM transitions to be performed within one cycle.

9. The mass spectrometer according to claim 6, wherein the information collector further comprises an information specifier for allowing an analysis operator to specify a plurality of SIM measurement target ions or a plurality of MRM transitions to be performed within one cycle.

10. The mass spectrometer according to claim 2, wherein the ion source is an ion source which employs an electrospray ionization (ESI) method and includes a nozzle for spraying a sample solution while electrically charging this solution, and the application voltage is a voltage applied to the nozzle.

11. The mass spectrometer according to claim 3, wherein the ion source is an ion source which employs an electrospray ionization (ESI) method and includes a nozzle for spraying a sample solution while electrically charging this solution, and the application voltage is a voltage applied to the nozzle.

12. The mass spectrometer according to claim 4, wherein the ion source is an ion source which employs an electrospray ionization (ESI) method and includes a nozzle for spraying a sample solution while electrically charging this solution, and the application voltage is a voltage applied to the nozzle.

13. The mass spectrometer according to claim 6, wherein the ion source is an ion source which employs an electrospray ionization (ESI) method and includes a nozzle for spraying a sample solution while electrically charging this solution, and the application voltage is a voltage applied to the nozzle.

14. The mass spectrometer according to claim 7, wherein the ion source is an ion source which employs an electrospray ionization (ESI) method and includes a nozzle for spraying a sample solution while electrically charging this solution, and the application voltage is a voltage applied to the nozzle.

15. The mass spectrometer according to claim 8, wherein the ion source is an ion source which employs an electrospray ionization (ESI) method and includes a nozzle for spraying a sample solution while electrically charging this solution, and the application voltage is a voltage applied to the nozzle.

16. The mass spectrometer according to claim 9, wherein the ion source is an ion source which employs an electrospray ionization (ESI) method and includes a nozzle for spraying a sample solution while electrically charging this solution, and the application voltage is a voltage applied to the nozzle.

* * * * *